United States Patent [19]

Kukes et al.

[11] Patent Number: 4,834,865

[45] Date of Patent: May 30, 1989

[54] HYDROCRACKING PROCESS USING DISPARATE CATALYST PARTICLE SIZES

[75] Inventors: Simon G. Kukes; Jeffrey T. Miller, both of Naperville; L. C. Gutberlet, Wheaton; Jeffrey C. Kelterborn, Hinsdale, all of Ill.

[73] Assignee: Amoco Corporation, Chicago, Ill.

[21] Appl. No.: 160,524

[22] Filed: Feb. 26, 1988

[51] Int. Cl.[4] ..... C10G 65/10

[52] U.S. Cl. ..... 208/59; 208/111; 208/210; 208/112; 502/314; 502/315; 502/335; 502/337; 502/439; 502/64; 502/79

[58] Field of Search ..... 208/59, 89, 111, 210, 208/112; 502/66, 73, 84, 305, 314, 315, 64, 79, 439, 335, 337

[56] References Cited

U.S. PATENT DOCUMENTS

| | | | |
|---|---|---|---|
| 3,026,260 | 3/1962 | Watkins | 208/59 |
| 3,563,886 | 2/1971 | Carlson et al. | 208/210 |
| 3,617,486 | 11/1971 | Lewis et al. | 208/111 |
| 3,725,251 | 4/1973 | Alpert et al. | 208/210 |
| 3,796,655 | 3/1974 | Armistead et al. | 208/146 |
| 3,809,644 | 5/1974 | Johnson et al. | 208/210 |
| 3,857,780 | 12/1974 | Gustafson | 208/139 |
| 3,963,600 | 6/1976 | Hilfman | 208/59 |
| 4,017,382 | 4/1977 | Bonnell et al. | 208/210 |
| 4,421,633 | 12/1983 | Shih et al. | 208/89 |
| 4,500,415 | 2/1985 | Simo et al. | 208/59 |
| 4,517,073 | 5/1985 | Ward et al. | 502/66 |
| 4,563,434 | 1/1986 | Ward et al. | 502/66 |
| 4,576,711 | 3/1986 | Ward et al. | 502/74 |
| 4,619,759 | 10/1986 | Myers et al. | 208/210 |
| 4,657,663 | 4/1987 | Gardner et al. | 208/210 |

*Primary Examiner*—Anthony McFarlane

*Attorney, Agent, or Firm*—Ekkehard Schoettle; William H. Magidson; Ralph C. Medhurst

[57] ABSTRACT

Disclosed is a hydrocracking process employing a plurality of reaction zones wherein at least one reaction zone contains a small nominal size hydrocracking catalyst (10 to 16 U.S. Sieve mesh size) and wherein the catalyst situated upstream of the small nominal size hydrocracking has a particle size greater than the small nominal size hydrocracking catalyst.

28 Claims, 3 Drawing Sheets

HYDROCRACKING PROCESS USING DISPARATE CATALYST PARTICLE SIZES

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. Hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products.

Hydrocracking catalysts generally comprise a hydrogenation component on an acidic cracking support. More specifically, hydrocracking catalysts comprise a hydrogenation component selected from the group consisting of Group VIB metals and Group VIII metals of the Periodic Table of Elements, their oxides or sulfides. The prior art has also taught that these hydrocracking catalysts contain an acidic support comprising a crystalline aluminosilicate material such as X-type and Y-type aluminosilicate materials. This crystalline aluminosilicate material is generally suspended in a refractory inorganic oxide such as silica, alumina, or silica-alumina.

Regarding the hydrogenation component the preferred Group VIB metals are tungsten and molybdenum the preferred Group VIII metals are nickel and cobalt. The prior art has also taught that combinations of metals for the hydrogenation component, expressed as oxides and in the order of preference, are: $NiO-WO_3$, $NiO-MoO_3$, $CoO-MoO_3$, and $CoO-WO_3$. Other hydrogenation components broadly taught by the prior art include iron, ruthenium, rhodium, palladium, osmium, indium, platinum, chromium, vanadium, niobium, and tantalum.

As can be appreciated from the above, there is a myriad of catalysts or catalyst systems known for hydrocracking whose properties vary widely. A catalyst suitable for maximizing naphtha yield may not be suitable for maximizing the yield of turbine fuel or distillate. Further, the various reactions; i.e., denitrogenation, hydrogenation, and hydrocracking must be reconciled in a hydrocracking process in an optimum manner to achieve the desired results.

For instance when a feedstock having a high nitrogen content is exposed to a hydrocracking catalyst containing a high amount of cracking component the nitrogen serves to poison or deactivate the cracking component. Thus, hydrodenitrogenation catalysts do not possess a high cracking activity since they are generally devoid of a cracking component that is capable of being poisoned. Another difficulty is presented when the hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatics content. This is due to the undesirable smoke production caused by the combustion of aromatics in diesel engines and jet engines.

Prior art processes designed to convert high nitrogen content feedstocks are usually two stage processes wherein the first stage is designed to convert organic nitrogen compounds to ammonia prior to contacting with a hydrocracking catalyst which contained a high amount of cracking component; e.g., a molecular sieve material.

For instance U.S. Pat. No. 3,923,638 to Bertolacini et al. discloses a two catalyst process suitable for converting a hydrocarbon containing substantial amounts of nitrogen to saturated products adequate for use as jet fuel. Specifically, the subject patent discloses a process wherein the hydrodenitrogenation catalyst comprises as a hydrogenation component a Group VIB metal and group VIII metal and/or their compounds and a cocatalytic acidic support comprising a large-pore crystalline aluminosilicate material and refractory inorganic oxide. The hydrocracking catalyst comprises as a hydrogenation component a Group VIB metal and a Group VIII metal and/or their compounds, and an acidic support of large-pore crystalline aluminosilicate material. For both hydrodenitrogenation catalyst and the hydrocracking catalyst, the preferred hydrogenation component comprises nickel and tungsten and/or their compounds and the preferred large-pore crystalline aluminosilicate material is ultrastable, largepore crystalline aluminosilicate material.

The prior art has also generally disclosed that the activity of a catalyst can be increased by decreasing the particle size of a catalyst. For instance, U.S. Pat. No. 3,857,780 (Gustafson) teaches that a reduction in catalyst particle size increases the activity of hydroforming catalysts. U.S. Pat. No. 3,796,655 (Armistead et al.) discloses a hydrodesulfurization process in which a small particle size catalyst is utilized to increase catalyst activity. Further, this patent recognizes that decreasing catalyst size (1/16-inch to 1/32-inch) while maintaining all other parameters constant, e.g., reactor dimensions and space velocity, results in a pressure drop increase that reduces the catalyst activity advantage. Similarly, U.S. Pat. No. 3,563,886 (Carson et al.) discloses a hydrddesulfurization process wherein the catalyst has increased activity and a particle size diameter between 1/20-inch and 1/40-inch. This patent presents data relating reactor pressure drop to catalyst particle size and reactor diameter. Thus, the prior art has recognized that this increase in activity afforded by a reduction in catalyst size is offset by an increase in the pressure gradient through the reaction system. Hence any catalyst system implementing this increase in activity phenomenon must also display a tolerable pressure gradient.

The various prior art hydrocracking processes do not exploit distinctions in catalyst particle size in any discernible manner. U.S. Pat. No. 4,120,825 (Ward) discloses a denitrogenation-hydrocracking process that utilizes a catalyst containing zeolitic aluminosilicates, alumina, and at least one of the metals, oxides and sulfides of Groups VIB and VIII. This catalyst as disclosed in Example 1 was formed into 1/16-inch extrudates.

U.S. Pat. No. 4,689,137 (Clark) discloses a hydrocracking catalyst containing a crystalline aluminosilicate zeolite ion-exchanged with rare earth cations and Group VIII noble metal cations in combination with a porous, inorganic refractory oxide. Example I shows that this catalyst was in a particulate form consisting of ⅛-inch extrudate.

U.S. Pat. No. 3,431,196 (Dobres) discloses a hydrocracking catalyst that contains nickel and/or cobalt in combination with a Z-14 U.S. zeolite and silica-alumina. Example 1 shows that the catalyst support granules were sized to obtain particles that are retained on a 24 mesh sieve and that passed through a 14 mesh sieve (U.S. Sieve).

U.S. Pat. No. 3,923,638 (Bertolacini et al.), mentioned above, in Example I shows a hydrodenitrogenation catalyst that passes through a 20-mesh sieve (U.S. Sieve), but not a 40-mesh sieve (U.S. Sieve). Example II discloses a hydrocracking catalyst that passes through a 12-mesh sieve (U.S. Sieve) but not a 20-mesh sieve (U.S. Sieve).

U.S. Pat. Nos. 4,576,711, 4,563,434, and 4,517,073 all to Ward et al. disclose in Example I a hydrocracking catalyst that has been extruded in a die having openings between 1/32 and ⅛ inch wherein the extruded material is subsequently cut into lengths of about 1/32 to ¾ inch preferably ¼ to ½ inch. Example II discloses hydrocracking particulate catalysts having a three-leaf clover cross-sectional shape with a diameter between 0.02 and 0.04 inches and a length between ¼ and ½ inches.

U.S. Pat. No. 3,649,523 (Bertolacini et al.) discloses hydrocracking catalysts that pass through a 12-mesh sieve (U.S. Sieve) but not a 20-mesh sieve (U.S. Sieve).

The prior art does not disclose or suggest that the selectivity of a hydrocracking process towards naphtha can be improved by using disparate catalyst particle sizes in a plurality of reaction zones in series, wherein a reaction zone containing catalyst having a relatively small nominal particle size is situated downstream of a reaction zone containing catalyst having a greater particle size. The hydrocracking process of the present invention provides a substantial naphtha selectivity advantage and concomitantly affords greater catalyst activity with less light gas production while not deleteriously increasing the pressure gradient across the reaction zones.

SUMMARY OF THE INVENTION

This invention in a broad aspect comprises a process for the hydrocracking of a hydrocarbon feedstock which comprises reacting the feedstock with hydrogen at hydrocracking conversion conditions in a plurality of reaction zones in series wherein at least one of the reaction zones contains a small nominal size hydrocracking catalyst having a particle U.S. Sieve mesh size ranging from about 10 to about 16 and wherein at least one reaction zone upstream of the reaction zone containing the small nominal size hydrocracking catalyst contains a large nominal size hydrocracking catalyst having a particle size greater than the small nominal size hydrocracking catalyst particle size.

In a specific aspect of the present invention, the small and large nominal size hydrocracking catalysts both contain a hydrogenation component comprising a Group VIB metal component and a Group VIII metal component deposed on a support component comprising a crystalline molecular sieve component, and a refractory inorganic oxide component.

In another specific aspect of the invention, the small nominal size hydrocracking catalyst comprises in combination a cobalt component, a molybdenum component and a support component comprising a silica-alumina component and a crystalline molecular sieve component while the large nominal size hydrocracking catalyst comprises in combination a nickel component, a tungsten component and a support component containing an alumina component and a crystalline molecular sieve component.

In yet another specific aspect of the present invention, the particle size of the large nominal size hydrocracking catalyst ranges from about 5 to about 7 mesh (U.S. Sieve).

BRIEF DESCRIPTION OF THE DRAWINGS

FIG. 1 schematically depicts four reactors, wherein

DETAILED DESCRIPTION OF THE INVENTION

Figure 1A:
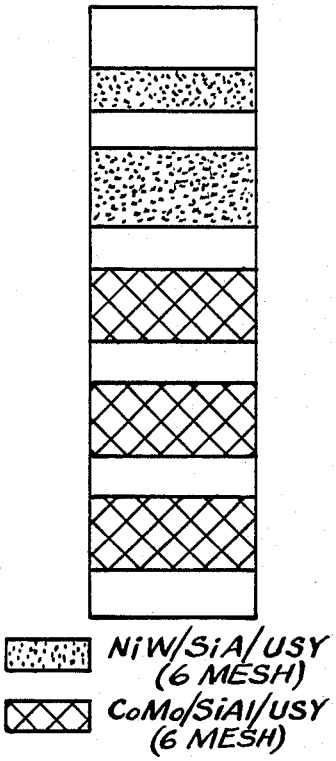
FIG. 1*a* and FIG. 1*b* show reactors chargted with a plurality of reaction zones in accordance with the prior art practice.
Figure 1B:
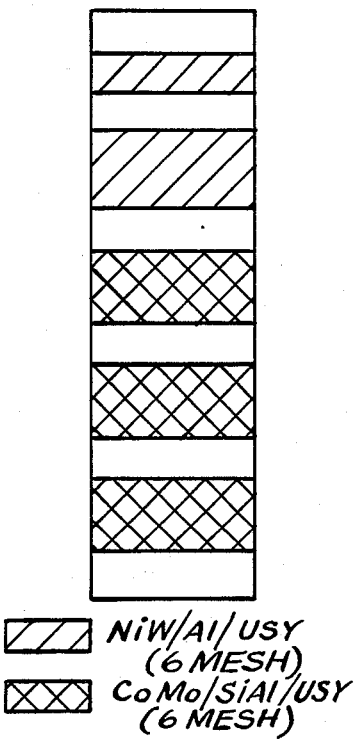
Figure 1C:
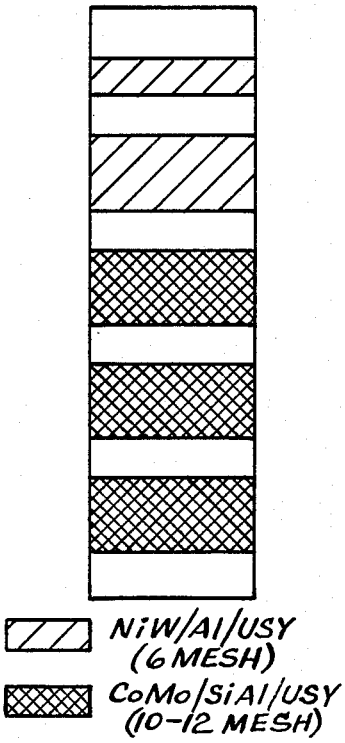
FIG. 1*c* and FIG. 1*d* show reactors charged in accordance with the present invention.
Figure 1D:
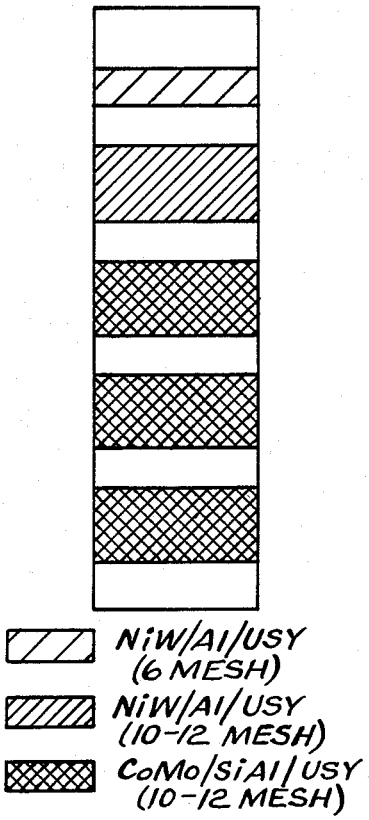

The hydrocarbon charge stock subject to hydrocracking in accordance with the process of this invention is suitably selected from the group consisting of petroleum distillates, solvent deasphalted petroleum residua, shale oils and coal tar distillates. These feedstocks typically have a boiling range above about 200° F. and generally have a boiling range between 350° to 950° F. More specifically these feedstocks include heavy distillates, heavy straight-run gas oils and heavy cracked cycle oils, as well as fluidized catalytic cracking unit feeds. The process of the invention is especially suitable in connection with handling feeds that include a light catalytic cycle oil. This light catalytic cycle oil generally has a boiling range of about 350° to about 750° F., a sulfur content of about 0.3 to about 2.5 wt %, a nitrogen content of about 0.01 to about 0.15 wt % and an aromatics content of about 40 to about 90 vol. %. The light catalytic cycle oil is a product of the fluidized catalytic cracking process.

Operating conditions to be used in the hydrocracking reaction zones include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is naphtha selective with decreased production of light gases.

The process of the present invention is carried out in a plurality of reaction zones. Each reaction zone can comprise one or several beds containing catalyst. Each catalyst bed can have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

Typically in the process of the present invention in the initial reaction zone the denitrogenation and desulfurization reactions predominate resulting in the production of ammonia and hydrogen sulfide. In the present invention, however, there is no removal of this ammonia and hydrogen sulfide by means of an intermediate separation step.

In accordance with the process of the present invention, at least one of the plurality of reaction zones contains a small nominal size hydrocracking catalyst having a particle size that ranges from about 10 to about 16 U.S. Sieve mesh size. Preferably the particle size of the small nominal size hydrocracking catalyst ranges from about 10 to 12 U.S. sieve mesh size. At least one other reaction zone situated upstream of the reaction zone containing the small nominal size hydrocracking catalyst contains a relatively greater particle size large nominal size hydrocracking catalyst. The particle size of the large nominal size hydrocracking catalyst preferably ranges from about 5 to about 7 U.S. Sieve mesh size.

As is explained in further detail below, a further reduction in size of the small nominal size hydrocracking catalyst beyond the size stipulated in the present invention does not produce an improvement in catalyst activity or selectivity towards naphtha. Such a further reduction can result in an undesirable increase in the pressure gradient across the reactor as evidenced in U.S. Pat. Nos. 3,796,655 (Armistead et al.) and 3,563,886 (Carlson et al.).

The relatively larger particle size of the large nominal size hydrocracking catalyst situated upstream of the small nominal size hydrocracking catalyst serves to capture impurities such as Fe, Si, Na, C, etc., and precludes contact of these impurities with the small nominal size hydrocracking catalyst.

Generally, the small nominal size hydrocracking catalyst will be present in an amount ranging from about 5 to about 70 wt. % of the total overall amount of catalyst used in the process of the invention. Preferably, this amount will range from about 10 to about 60 wt. %. These amounts can be distributed in several reaction zones or beds. The amount of small nominal size hydrocracking catalyst used in the process of the invention can be limited in accordance with the desired overall pressure gradient. This amount can be readily calculated by those skilled in the art as explained in U.S. Pat. Nos. 3,796,655 (Armistead et al.) and 3,563,886 (Carlson et al.).

The catalyst used in the present invention can be used in any form such as pellets, spheres, extrudates, or other shapes having particular cross sections such as a clover leaf, or "C" shape, provided the sieve mesh size constraints for the catalyst are adhered to.

The hydrogenation component of the catalysts employed in the process of the invention comprises a Group VIB metal component and a Group VIII metal component. These components are typically present in the oxide or sulfide form.

The amounts of Group VIB metals and Group VIII metals present in the catalysts are set out below on an elemental basis and based on the total catalyst weight.

| | Broad | Preferred | Most Preferred |
|---|---|---|---|
| Group VIB | 3–30 | 6–25 | 8–20 |
| Group VII | 0.5–10 | 1–6 | 1.5–4 |

The preferred Group VIB metals are molybdenum and tungsten, while the preferred Group VIII metals are cobalt and nickel.

When the hydrogenation component of the present invention comprises cobalt and molybdenum and/or their compounds, these metals are present in the amounts specified below. These amounts are based on the total catalytic composite or catalyst weight and are calculated as the oxides CoO and $MoO_3$.

| | Broad | Preferred | Most Preferred |
|---|---|---|---|
| CoO, wt. % | 1–6 | 1.5–5 | 2–4 |
| $MoO_3$, wt. % | 3–20 | 6–15 | 8–12 |

When the hydrogenation component of the present invention comprises nickel and tungsten and/or their compounds. The nickel and tungsten are present in the amounts specified below. These amounts are based on the total catalytic composite or catalyst weight and are calculated as the oxides, NiO and $WO_3$. In another embodiment of the present invention, the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–10.0 | 0.0–6.0 | 0.0–3.0 |

The hydrogenation component may be deposed upon the support by impregnation employing heat-decomposable salts of the above-described metals or any other method known to those skilled in the art. Each of the metals may be impregnated onto the support separately, or they may be co-impregnated onto the support. The composite is subsequently dried and calcined to decompose the salts and to remove the undesired anions.

Another component of the catalytic composite or catalyst is the support. The support comprises a crystalline molecular sieve material and a refractory inorganic oxide such as silica, alumina, or silica-alumina. The crystalline molecular sieve material is present in an amount ranging from about 10 to about 60 wt. %, preferably from about 25 to about 50 wt. %. Preferably, the crystalline molecular sieve material is distributed throughout and suspended in a porous matrix of the refractory oxide.

Where the hydrogenation components are nickel and tungsten, the preferred refractory oxide in the support is alumina, in contradistinction to U.S. Pat. Nos. 4,576,711, 4,563,434, and 4,517,073 to Ward et al. and U.S. Pat. No. 3,536,605 to Kittrell et al. which require the presence of silica-alumina matrix material. Alumina is a preferred support component suitable for increasing hydrogenation activity as opposed to hydrocracking activity.

Where the hydrogenation components are cobalt and molybdenum, the preferred refractory inorganic oxide in the support is silica-alumina because it serves to yield a product containing a higher iso to normal ratio for the pentane fraction thereof.

It is preferable to carry out the hydrogenation reactions prior to the hydrocracking reactions because the hydrocracking reaction will take place at a faster rate with hydrogenated reactants.

In any event, the support may be prepared by various well-known methods and formed into pellets, beads, and extrudates of the desired size. For example, the crystalline molecular sieve material may be pulverized into finely divided material, and this latter material may be intimately admixed with a refractory inorganic oxide such as gamma alumina. The finely divided crystalline molecular sieve material may be admixed thoroughly with a hydrosol or hydrogel of the gamma alumina. Where a thoroughly blended hydrogel is obtained, this hydrogel may be dried and broken into pieces of desired shapes and sizes. The hydrogel may also be formed into small spherical particles by conventional spray drying techniques or equivalent means.

Such molecular sieve materials are preferably selected from the group consisting of a faujasite-type crystalline aluminosilicates, and mordenite-type crystalline aluminosilicates. Although not preferred, crystalline aluminosilicates such as ZSM-5, ZSM-11, ZSM-12, ZSM-23, and ZSM-35, and an AMS-1B crystalline molecular sieve can also be used with varying results alone or in combination with the faujasite-type or mordenite-type crystalline aluminosilicates. Examples of a faujasite-type crystalline aluminosilicate are high- and low-alkali metal Y-type crystalline aluminosilicates, metal-exchanged X-type and Y-type crystalline aluminosilicates, and ultrastable, large-pore crystalline aluminosilicate material. Zeolon is an example of a mordenite-type crystalline aluminosilicate.

Ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability in elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt. % sodium) was shown to have a loss in nitrogen-absorption capacity that is less than 2% per wetting, when tested for stability to wetting by subjecting the material to a number of consecutive cycles, each cycle consisting of a wetting and a drying.

The ultrastable, large-pore crystalline aluminosilicate material that is preferred for the catalytic-composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.60 A. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,625 $cm^{-1}$ (3,610±15 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkaline metal content of less than 1%.

Another example of a crystalline molecular sieve zeolite that can be employed in the catalytic composition of the present invention is a metal-exchanged Y-type molecular sieve. Y-type zeolitic molecular sieves are discussed in U.S. Pat No. 3,130,007. The metal-exchanged Y-type molecular sieve can be prepared by replacing the original cation associated with the molecular sieve by a variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such a rare earth metal-exchanged Y-type molecular sieve can be employed suitably in the catalytic composition of the present invention. Specific examples of suitable rare earth metals are cerium, lanthanum, and praseodymium.

As mentioned above, another zeolitic molecular sieve material that can be used in the catalytic composition of the present invention is ZSM-5 crystalline zeolitic molecular sieves. Descriptions of the ZSM-5 composition and its method of preparation are presented by Argauer, et al., in U.S. Pat. No. 3,702,886. This patent is incorporated by reference herein and made a part hereof.

An additional molecular sieve that can be used in the catalytic compositions of the present invention is AMS-1B crystalline borosilicate, which is described in U.S. Pat. No. 4,269,813, which patent is incorporated by reference herein and made a part thereof.

A suitable AMS-1B crystalline borosilicate is a molecular sieve material having the following composition in terms of mole ratios of oxides:

$$0.9\pm0.2M_{2/n}O: B_2O_3:YSiO_2: ZH_2O,$$

wherein M is at least one cation having a valence of n, Y is within the range of 4 to about 600, and Z is within the range of 0 to about 160, and providing an X-ray diffraction pattern comprising the following X-ray diffraction lines and assigned strengths:

| d(Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

In a preferred embodiment of the invention the small nominal size hydrocracking catalyst contains a cobalt component and a molybdenum component deposed on a support comprising a silica-alumina component and a crystalline molecular sieve material. This small nominal size hydrocracking catalyst is preferably present in three reaction beds. The large nominal size hydrocracking catalyst is situated in two reaction beds upstream of the small nominal size hydrocracking catalyst. This large nominal size hydrocracking catalyst preferably contains a nickel component, and a tungsten component, deposed on a support containing an alumina component and a crystalline molecular sieve material.

In another preferred embodiment at least one portion of the small nominal size hydrocracking catalyst contains a catalyst having a cobalt component and a molybdenum component deposed on a support comprising a silica-alumina component and a crystalline molecular sieve material while a second upstream portion of the small nominal size hydrocracking catalyst is a catalyst containing a nickel component and a tungsten component supported on a support component containing an alumina component and a crystalline molecular sieve material. The first portion of the small nominal size catalyst generally is present in an amount ranging from 10 to 60 wt. % based on the total weight of small nominal size hydrocracking catalyst.

The present invention is described in further detail in connection with the following examples, it being understood that these examples are for purposes of illustration and not limitation.

EXAMPLE I

The process of the invention was compared with two comparative processes. Specifically, FIG. 1 schematically shows the juxtaposition of catalyst zones in comparative reactors depicted in FIG. 1*a* and FIG. 1*b* where all of the catalyst loaded into each reactor possessed the same U.S. sieve mesh size ranging from 5 to 7, not in accordance with the present invention. The reactors depicted in FIG. 1*c* and FIG. 1*d* were loaded in accordance with the present invention wherein the downstream reaction zones contain a hydrocracking catalyst having a mesh size ranging from about 10 to 16 and the upstream reaction zones contain a hydrocracking catalyst possessing a greater particle size, namely a size ranging from about 5 to 7 U.S. sieve mesh size.

Each of the reactors depicted in FIG. 1 possessed a 1-inch diameter and was charged with an overall amount of about 36 cc of catalyst mixed with about 70 cc of inert alundum. Each catalyst bed or reaction zone depicted in FIG. 1 was loaded in accordance with 1:2 volume ratio of catalyst to alundum. The first bed or most upstream bed in each reactor contained 4 cc of catalyst while each of the subsequent beds in each reactor contained 8 cc of catalyst.

Each reactor load was sulfided prior to the test run. In each test run the reactor was purged with $N_2$ for about 15 minutes, followed by passing a $H_2S/H_2$ gas mixture over the catalyst at 350° F., 1 atm. pressure and a flow rate of about 1 $ft^3$/hr overnight.

The next day the reactor temperature in each reactor was slowly raised to 700° F. The sulfiding gas was subsequently charged to the reactor for about 2 hours.

Four test runs were then carried out with catalyst charges loaded as depicted in FIG. 1 on a once-through basis at a pressure of 1250 psig, a liquid hourly space velocity (LHSV) of about 1.2, and a hydrogen flow rate of about 12,500 SCFB. The temperature of the reactor in each test run was adjusted to maintain about 77 wt. % conversion of the feedstock boiling above 380° F. to a material boiling below 380° F.

Table 1 below sets out the properties of the light catalytic cycle oil feedstock used in each test run.

TABLE 1

| Feed Properties | |
|---|---|
| API gravity | 21.9 |
| C, % | 89.58 |
| H, % | 10.37 |
| S, % | 0.55 |
| N, ppm | 485 |
| Total aromatics, wt % | 69.5 |
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the composition of each catalyst used in the present example runs 1 through 4. The catalyst loadings for runs 1 through 4 correspond respectively to the reactors depicted in FIG. 1: namely FIG. 1*a*, FIG. 1*b*, FIG. 1*c*, and FIG. 1*d*.

TABLE 2

| | PROPERTIES OF CATALYSTS | | | |
|---|---|---|---|---|
| | NiW/SiAl/USY | NiW/Al/USY | CoMo/SiAl/USY | |
| Chemical Composition wt % | | | | |
| $MoO_3$ | | | 10.55 | 10.60 |

TABLE 2-continued

| PROPERTIES OF CATALYSTS | NiW/SiAl/USY | NiW/Al/USY | | CoMo/SiAl/USY | |
|---|---|---|---|---|---|
| $WO_3$ | 17.60 | 17.78 | 17.53 | — | — |
| NiO | 2.13 | 1.90 | 1.97 | — | — |
| CoO | — | — | — | 2.5 | 3.0 |
| $Na_2O$ | .09 | .13 | .14 | .07 | — |
| $SO_4$ | .21 | .29 | .31 | .13 | — |
| Support Composition, wt % | | | | | |
| silica | | | | | |
| alumina | | 65 | 65 | | |
| silica-alumina | 65 | | | 65 | 65 |
| crystalline molecular sieve | 35 | 35 | 35 | 35 | 35 |
| Surface Properties | | | | | |
| S. A., $m^2/g$ | 348 | 350 | 350 | 384 | 386 |
| Unit Cell Size | 24.52 | 24.51 | 24.51 | 24.52 | — |
| Crystallinity, % | 105 | 94 | 93 | 110 | — |
| Physical Properties | | | | | |
| Density, $lbs/ft^3$ | 52.8 | 49.7 | 49.6 | 45.5 | 43.0 |
| Crush Strength, lbs/mm | 7.4 | 7.4 | 5.9 | 4.5 | 4.0 |
| Abrasion Loss, wt % (1 hr) | .8 | 1.2 | 2.1 | .4 | .3 |
| Mesh Size (U.S. Sieve) | 5–7 | 5–7 | 10–16 | 5–7 | 10–16 |

Table 3 below shows the results of runs 1 through 4 as product selectivities corrected to 77 wt. % conversion and 725° F. These selectivities were calculated from "corrected yields." The method and equations used to calculate yields at the common conditions of 725° F. and 77 weight percent conversion are set out at U.S. Pat. No. 3,923,638 (Bertolacini et al.), the teachings of which are incorporated by reference.

Selectivity is calculated as the percentage of hydrocarbon products boiling in the desired range to those boiling from the boiling point of $C_4$ to the end point of the product.

TABLE 3

| CRACKING SELECTIVITY (WEIGHT, %) | | | | | |
|---|---|---|---|---|---|
| Run No. | 1 | 2 | 3 | 4 | 95% Confidence Limits |
| Dry Gas | 5.69 | 5.30 | 5.01 | 4.94 | .09 |
| Butane | 13.07 | 12.81 | 12.00 | 11.50 | .17 |
| Pentane | 11.27 | 11.20 | 10.84 | 10.57 | .08 |
| Lt. Naphtha | 16.61 | 17.29 | 16.74 | 16.09 | .10 |
| Hvy. Naphtha | 56.36 | 56.45 | 58.40 | 59.91 | .27 |
| I/N Pentane | 3.60 | 3.07 | 2.89 | 2.94 | .11 |
| I/N Butane | 1.16 | 1.34 | 1.34 | 1.32 | .02 |

The data clearly shows increased total naphtha yields for runs 3 and 4 in accordance with the present invention as opposed to comparative runs 1 and 2. Yields of dry gases decreased from the control Runs 1 and 2, to Runs 3 and 4 in accordance with the present invention.

Runs 3 and 4 especially highlight the selectivity improvement towards naphtha afforded by the present invention. Invention Run 3 utilized the same catalyst system as comparative Run 2 except the three downstream beds contained catalyst particles sized in accordance with the present invention.

This increase in selectivity is surprising since it had previously been thought in connection with non-analogous processes that a reduction in catalyst size resulted only in an increase in catalyst activity.

Figure 2:
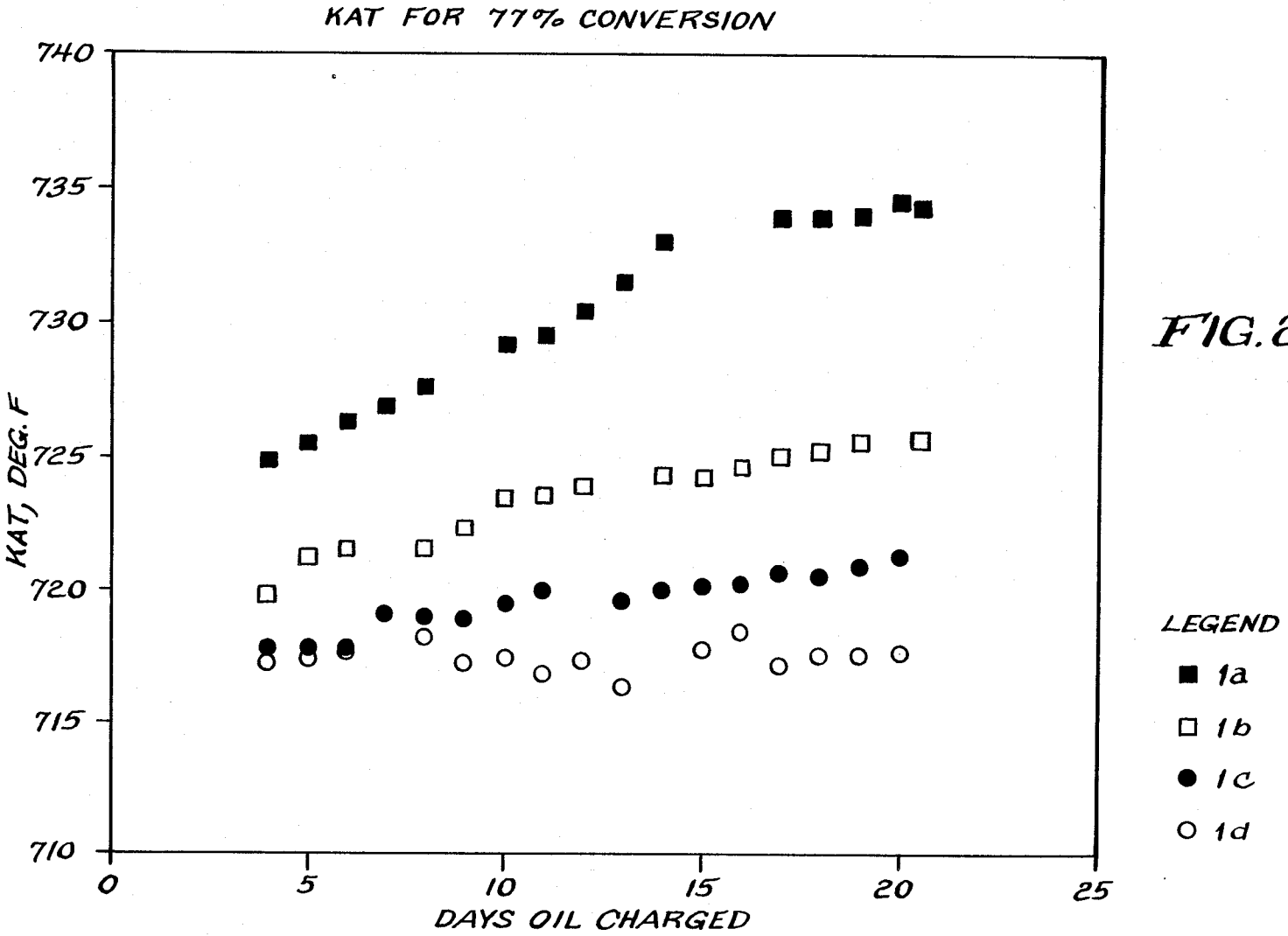
FIG. 2 depicts a plot of the hydrocracking catalyst activity; i.e., the adjusted temperature required to achieve 77 wt. % conversion as a function of days oil charged for tests carried out with reactors loaded in accordance with the FIG. 1 schematic drawings.

FIG. 2 shows the catalyst activity for each run over an extended period of time. This figure also shows the stability for each run, i.e., change in reactor temperature (activity) required to maintain 77% conversion for the given feedstock. This graph shows the significant advantages afforded by the process of the invention with respect to catalyst activity and stability.

EXAMPLE II

In the present example three test runs were carried out to demonstrate criticality of the catalyst particle size stipulated by the process of the invention. In this example each run was carried out with a single size catalyst loading having a nominal particle size of 1/22-inch, 1/16-inch and ⅛-inch (14–16, 10–12, and 5–7, respectively, U.S. sieve mesh size). The catalyst used in each run contained the following composition: NiW/SiAl-/USY in the following respective amounts 20–40 grams. The feedstock used in each run is characterized in Table 1 above. Each run was carried out at 1250 psig pressure, a hydrogen addition rate of about 12,500 SCFB, and a liquid hourly space velocity of about 1.45

Figure 3A:
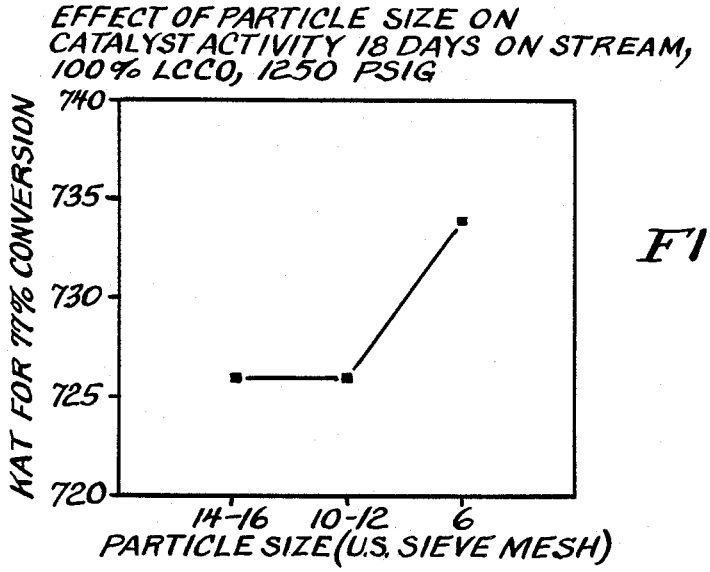
FIG. 3 depicts three plots, FIG. 3*a*, 3*b*, and FIG. 3*c* showing hydrocracking activity, heavy naphtha yield, and light naphtha yield respectively as functions of catalyst particle size.
Figure 3B:
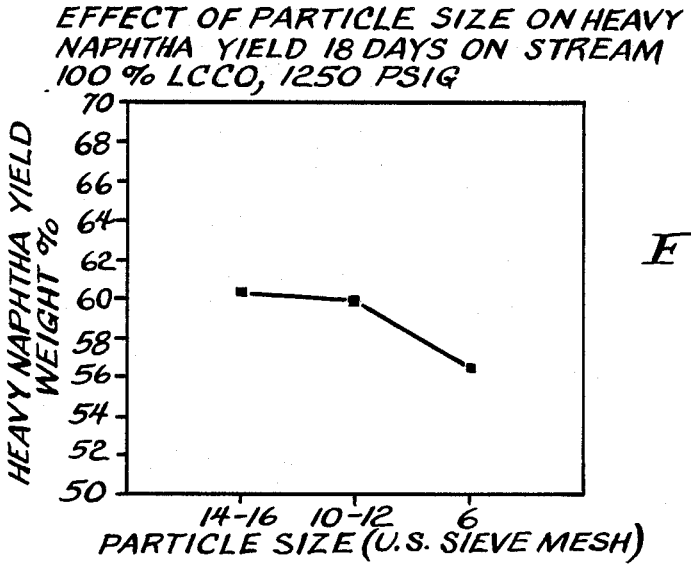
Figure 3C:
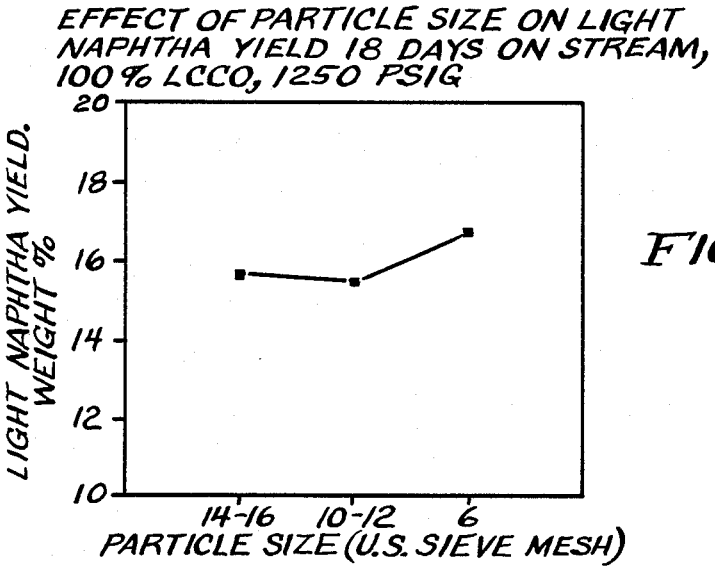

FIG. 3*a*, FIG. 3*b* and FIG. 3*c* graphically set out the relevant results for each run.

FIG. 3*a*, FIG. 3*b*, and FIG. 3*c* show that there is no further advantage afforded by reducing the catalyst mesh size below about 14 to 16 (U.S. Sieve) with respect to catalyst activity and naphtha yield.

What is claimed is:

1. A process for the hydrocracking of a hydrocarbon feedstock which comprises reacting said feedstock with hydrogen at hydrocracking conversion conditions in a plurality of reaction zones in series containing hydrocracking catalyst wherein at least one of said reaction zones contains a small nominal size hydrocracking catalyst wherein said small nominal size catalyst has a U.S. sieve mesh size ranging from about 10 to about 16, and wherein at least one reaction zone upstream of said reaction zone containing said small nominal size hydrocracking catalyst having a particle size greater than said small nominal size hydrocracking catalyst.

2. The process of claim 1 wherein said small nominal size catalyst has a U.S. sieve mesh size ranging from about 10 to about 12.

3. The process of claim 1 wherein said small nominal size hydrocracking catalyst and said large nominal size hydrocracking catalyst each comprise a hydrogenation component comprising a Group VIB metal component and a Group VIII metal component deposed on a support component comprising a crystalline molecular sieve material and a refractory inorganic oxide component.

4. The process of claim 1 wherein said large nominal size hydrocracking catalyst possesses a particle size ranging from about 5 to about 7 mesh (U.S. Sieve).

5. The process of claim 3 wherein said small nominal size hydrocracking catalyst comprises a cobalt component and a molybdenum component deposed on a support comprising a silica-alumina component and a crystalline molecular sieve material and wherein said large nominal size hydrocracking catalyst comprises a nickel component and tungsten component deposed on a support consisting essentially of an alumina component and a crystalline molecular sieve material.

6. The process of claim 5 wherein said cobalt component is present in an amount ranging from about 1.5 to about 5 wt. % and the molybdenum component is present in an amount ranging from about 6 to about 15 wt. % both calculated as oxides and based on the total weight of small nominal size hydrocracking catalyst and wherein said nickel component is present in an amount ranging from about 1.5 to about 5.0 wt. % and said tungsten component is present in an amount ranging from about 15 to about 25 wt. % both calculated as oxides and based on the total weight of large nominal size hydrocracking catalyst.

7. The process of claim 5 wherein said cobalt component is present in an amount ranging from about 2 to about 4 wt. % and the molybdenum component is present in an amount ranging from about 8 to about 12 wt. % both calculated as oxides and based on the total weight of small nominal size hydrocracking catalyst and wherein said nickel component is present in an amount ranging from about 1.5 to about 4 wt. % and said tungsten component is present in an amount ranging from about 15 to about 20 wt. % both calculated as oxides and based on the total weight of large nominal size hydrocracking catalyst.

8. The process of claim 3 wherein said crystalline molecular sieve material is a Y zeolite.

9. The process of claim 5 wherein said crystalline molecular sieve material is a Y zeolite.

10. The process of claim 6 wherein said crystalline molecular sieve material is Y zeolite.

11. The process of claim 7 wherein said crystalline molecular sieve material is a Y zeolite.

12. The process of claim 3 wherein a first portion of said small nominal size hydrocracking catalyst comprises a catalyst comprising a cobalt component and a molybdenum component deposed on a support comprising a silica-alumina component and a crystalline molecular sieve material and a second portion of said small nominal size hydrocracking catalyst located upstream of said first portion, comprises a catalyst having a nickel component and a tungsten component deposed on a support component consisting essentially of an alumina component and a crystalline molecular sieve material and wherein said large nominal size hydrocracking catalyst comprises a catalyst having a nickel component and a tungsten component deposed on a support component consisting essentially of an alumina component and a crystalline molecular sieve material.

13. The process of claim 12 wherein said first portion of small nominal size catalyst is present in an amount ranging from about 10 to about 60 wt. % based on the total weight of small nominal size catalyst.

14. The process of claim 1 wherein said small nominal size hydrocracking catalyst is present in an amount ranging from about 5 to about 70 wt. % based on the total amount of hydrocracking catalyst present in said plurality of reaction zones.

15. The process of claim 1 wherein said small nominal size hydrocracking catalyst is present in an amount ranging from about 10 to about 60 wt. % based on the total amount of hydrocracking catalyst present in said plurality of reaction zones.

16. The process of claim 5 wherein said small nominal size hydrocracking catalyst is present in an amount ranging from about 5 to about 70 wt. % based on the total amount of hydrocracking catalyst present in said plurality of reaction zones.

17. The process of claim 5 wherein said small nominal size hydrocracking catalyst is present in an amount ranging from about 10 to about 60 wt. % based on the total amount of hydrocracking catalyst present in said plurality of reaction zones.

18. The process of claim 6 wherein said small nominal size hydrocracking catalyst is present in an amount ranging from about 5 to about 70 wt. % based on the total amount of hydrocracking catalyst present in said plurality of reaction zones.

19. The process of claim 6 wherein said small nominal size hydrocracking catalyst is present in an amount ranging from about 10 to about 60 wt. % based on the total amount of hydrocracking catalyst present in said plurality of reaction zones.

20. The process of claim 7 wherein said small nominal size hydrocracking catalyst is present in an amount ranging from about 5 to about 70 wt. % based on the total amount of hydrocracking catalyst present in said plurality of reaction zones.

21. The process of claim 7 wherein said small nominal size hydrocracking catalyst is present in an amount ranging from about 10 to about 60 wt. % based on the total amount of hydrocracking catalyst present in said plurality of reaction zones.

22. The process of claim 12 wherein said crystalline molecular sieve material is a Y zeolite.

23. The process of claim 12 wherein said cobalt component is present in an amount ranging from about 2 to about 4 wt. % and the molybdenum component is present in an amount ranging from about 8 to about 12 wt. % both calculated as oxides and based on the total weight of said first portion of small nominal size hydrocracking catalyst, wherein said nickel component contained in said second portion is present in an amount ranging from about 1.5 to about 4 wt. % and said tungsten component is present in an amount ranging from about 15 to about 20 wt. % both calculated as oxides and based on the total weight of said second portion of small nominal size hydrocracking catalyst and wherein said nickel and tungsten are present in said large nominal size hydrocracking in the same amounts as in said second portion of small nominal size hydrocracking catalyst.

24. The process of claim 12 wherein said small nominal size hydrocracking catalyst is present in an amount ranging from about 10 to about 60 wt. % based on the total amount of hydrocracking catalyst present in said plurality of reaction zones.

25. The process of claim 12 wherein said small nominal size hydrocracking catalyst is present in an amount ranging from about 5 to about 70 wt. % based on the total amount of hydrocracking catalyst present in said plurality of reaction zones.

26. The process of claim 23 wherein said small nominal size hydrocracking catalyst is present in an amount ranging from about 10 to about 60 wt. % based on the total amount of hydrocracking catalyst present in said plurality of reaction zones.

27. The process of claim 23 wherein said small nominal size hydrocracking catalyst is present in an amount ranging from about 5 to about 70 wt. % based on the total amount of hydrocracking catalyst present in said plurality of reaction zones.

28. The process of claim 23 wherein said first portion of small nominal size catalyst is present in an amount ranging from about 10 to about 60 wt. % based on the total weight of small nominal size catalyst.

* * * * *